United States Patent [19]

Horvath et al.

[11] Patent Number: 4,618,982

[45] Date of Patent: Oct. 21, 1986

[54] DIGITAL SPEECH PROCESSING SYSTEM HAVING REDUCED ENCODING BIT REQUIREMENTS

[75] Inventors: Stephan Horvath; Carlo Bernasconi, both of Zurich, Switzerland

[73] Assignee: Gretag Aktiengesellschaft, Regensdorf, Switzerland

[21] Appl. No.: 421,884

[22] Filed: Sep. 23, 1982

[30] Foreign Application Priority Data

Sep. 24, 1981 [CH] Switzerland ..... 6168/81

[51] Int. Cl.[4] ..... G10L 5/00

[52] U.S. Cl. ..... 381/36

[58] Field of Search ..... 381/29-41

[56] References Cited

U.S. PATENT DOCUMENTS

| | | | |
|---|---|---|---|
| 3,017,456 | 1/1962 | Schreiber | 381/31 |
| 3,213,268 | 10/1965 | Ellersick | 340/347 DD |
| 3,236,947 | 2/1966 | Clapper | 381/41 |
| 3,439,753 | 4/1979 | Mounts et al. . | |
| 4,053,712 | 10/1977 | Reindl | 381/30 |
| 4,335,277 | 6/1982 | Puri | 381/51 |
| 4,360,708 | 11/1982 | Taguchi | 381/36 |

OTHER PUBLICATIONS

S. Chandra and W. C. Lin, "Linear Prediction with a Variable Analysis Frame Size", *IEEE Transactions on Acoustics, Speech and Signal Processing,* vol. ASSP-25, No. 4, pp. 322-330, Aug. 1977.

C. K. Un and D. Thomas Magill, "The Residual-Excited Linear Prediction Vocoder with Transmission Rate Below 9.6 kbits/s", *IEEE Transactions on Communications,* vol. COMM-23, No. 12, Dec. 1975.

S. Maitra and C. R. Davis, "Improvements in the Classical Model for Better Speech Quality", *IEEE International Conference on Acoustics, Speech, and Signal Processing,* vol. 1 of 3, pp. 23-28, Apr. 1980.

E. M. Hofstetter, "Microprocessor Realization of a Linear Predictive Vocoder", *IEEE Transactions on Acoustics, Speech, and Signal Processing,* vol. ASSP-25, No. 5, pp. 379-387, Oct. 1977.

*Primary Examiner*—E. S. Matt Kemeny

*Attorney, Agent, or Firm*—Burns, Doane, Swecker & Mathis

[57] ABSTRACT

A digitized speech signal is divided into sections and each section is analyzed by the linear prediction method to determine the coefficients of a sound formation model, a sound volume parameter, information concerning voiced or unvoiced excitation and the period of the vocal band base frequency. In order to improve the quality of speech without increasing the data rate, redundance reducing coding of the speech parameters is effected. The coding of the speech parameters is performed in blocks of two or three adjacent speech sections. The parameters of the first speech section are coded in a complete form, and those of the other speech sections in a differential form or in part not at all. The average number of bits required per speech section is reduced to compensate for the increased section rate, so that the overall data rate is not increased.

15 Claims, 4 Drawing Figures

| Bit Assignment Instruction | $p_i$ | $k_{1i}$ | $k_{2i}$ | $k_{3i}$ | $k_{4i}$ | $k_{5i}$ | $k_{6i}$ | $k_{7i}$ | $k_{8i}$ | $k_{9i}$ | $k_{10i}$ | $G_i$ |
|---|---|---|---|---|---|---|---|---|---|---|---|---|
| A1 | 7 | 7 | 6 | 5 | 5 | 5 | 4 | 4 | 4 | 3 | 2 | 5 |
| B1 | 7 | 6 | 5 | 5 | 4 | 4 | 3 | – | – | – | – | 5 |

| Bit Assignment Instruction | $\Delta p_i$ | $\Delta k_{1i}$ | $\Delta k_{2i}$ | $\Delta k_{3i}$ | $\Delta k_{4i}$ | $\Delta k_{5i}$ | $\Delta k_{6i}$ | $\Delta k_{7i}$ | $\Delta k_{8i}$ | $\Delta k_{9i}$ | $\Delta k_{10i}$ | $G_i$ |
|---|---|---|---|---|---|---|---|---|---|---|---|---|
| A 2 | 3 | – | – | – | – | – | – | – | – | – | – | 4 |
| A 3 | 3 | 6 | 5 | 4 | 4 | 4 | 3 | 3 | 3 | 2 | 2 | 5 |

With $\Delta p_i = p_i = p_{i-1}$ and $\Delta k_{ji} = k_{ji} = k_{ji-2}$ and C = Codeword = -4

| Bit Assignment Insstruction | $\Delta p_i$ | $k_{1i}$ | $k_{2i}$ | $k_{3i}$ | $k_{4i}$ | $k_{5i}$ | $k_{6i}$ | $k_{7i}$ | $k_{8i}$ | $k_{9i}$ | $k_{10i}$ | $G_i$ |
|---|---|---|---|---|---|---|---|---|---|---|---|---|
| B 2 | 3 | 6 | 5 | 5 | 4 | 4 | 3 | – | – | – | – | 4 |
| B 3 | 3 | 6 | 5 | 5 | 4 | 4 | 3 | – | – | – | – | 5 |

80
1
2
3
Filter
A/D
$s_n$
4
Vocal Parameter Calculator
$k_j, a_j$
G
Buffer
5
13
12
Trans.
Energ.
Invers. Filter
6
$e_n$
10
7
60
Autocorrel.
8
AKF
V/UV-Det.
Pitch.
9
11
p, $k_j$
G
Encoder
14
70
ANALYSIS
SYNTHESIS
Decoder
15
p
G
$k_j$
16
P/N Gen.
17
Vocal Model Filter
18
Filter
D/A
21
20
19

Fig. 4

| Bit Assignment Instruction | $p_i$ | $k_{1i}$ | $k_{2i}$ | $k_{3i}$ | $k_{4i}$ | $k_{5i}$ | $k_{6i}$ | $k_{7i}$ | $k_{8i}$ | $k_{9i}$ | $k_{10i}$ | $G_i$ |
|---|---|---|---|---|---|---|---|---|---|---|---|---|
| A1 | 7 | 7 | 6 | 5 | 5 | 5 | 4 | 4 | 4 | 3 | 2 | 5 |
| B1 | 7 | 6 | 5 | 5 | 4 | 4 | 3 | – | – | – | – | 5 |

| Bit Assignment Instruction | $\Delta p_i$ | $\Delta k_{1i}$ | $\Delta k_{2i}$ | $\Delta k_{3i}$ | $\Delta k_{4i}$ | $\Delta k_{5i}$ | $\Delta k_{6i}$ | $\Delta k_{7i}$ | $\Delta k_{8i}$ | $\Delta k_{9i}$ | $\Delta k_{10i}$ | $G_i$ |
|---|---|---|---|---|---|---|---|---|---|---|---|---|
| A 2 | 3 | – | – | – | – | – | – | – | – | – | – | 4 |
| A 3 | 3 | 6 | 5 | 4 | 4 | 4 | 3 | 3 | 3 | 2 | 2 | 5 |

With $\Delta p_i = p_i = p_{i-1}$ and $\Delta k_{ji} = k_{ji} = k_{ji-2}$ and C = Codeword = −4

| Bit Assignment Insstruction | $\Delta p_i$ | $k_{1i}$ | $k_{2i}$ | $k_{3i}$ | $k_{4i}$ | $k_{5i}$ | $k_{6i}$ | $k_{7i}$ | $k_{8i}$ | $k_{9i}$ | $k_{10i}$ | $G_i$ |
|---|---|---|---|---|---|---|---|---|---|---|---|---|
| B 2 | 3 | 6 | 5 | 5 | 4 | 4 | 3 | – | – | – | – | 4 |
| B 3 | 3 | 6 | 5 | 5 | 4 | 4 | 3 | – | – | – | – | 5 |

DIGITAL SPEECH PROCESSING SYSTEM HAVING REDUCED ENCODING BIT REQUIREMENTS

BACKGROUND OF THE INVENTION

The present invention relates to a linear prediction process, and corresponding apparatus, for reducing the redundance in the digital processing of speech in a system of the type wherein digitized speech signals are divided into sections and each section is analysed for model filter characteristics, sound volume and pitch.

Speech processing systems of this type, so-called LPC vocoders, afford a substantial reduction in redundance in the digital transmission of voice signals. They are becoming increasingly popular and are the subject of numerous publications and patents, examples of which include:

B. S. Atal and S. L. Hanauer, Journal Acoust. Soc. A., 50, p 637–655, 1971;

R. W. Schafer and L. R. Rabiner, Proc. IEEE, Vol. 63, No. 4, p 662–667, 1975;

L. R. Rabiner et al., Trans. Acoustics, Speech and Signal Proc., Vol. 24, No. 5, p. 399–418, 1976;

B. Gold. IEEE Vol. 65, No. 12, p.1636–1658, 1977;

A. Kurematsu et al., Proc. IEEE, ICASSP, Washington 1979, p. 69–72;

S. Horwath, "LPC-Vocoders, State of Development and Outlook", Collected Volume of Symposium Papers "War in the Ether", No. XVII, Bern 1978;

U.S. Pat. Nos. 3,624,302; 3,361,520; 3,909,533; 4,230,905.

The presently known and available LPC vocoders do not yet operate in a fully satisfactory manner. Even though the speech that is synthesized after analysis is in most cases relatively comprehensible, it is distorted and sounds artificial. One of the causes of this limitation, among others, is to be found in the difficulty in deciding with adequate safety whether a voiced or unvoiced section of speech is present. Further causes are the inadequate determination of the pitch period and the inaccurate determination of the parameters for a sound generating filter.

In addition to these fundamental difficulties, a further significant problem results from the fact that the data rate in many cases must be restricted to a relatively low value. For example, in telephone networks it is preferably only 2.4 kbit/sec. In the case of an LPC vocoder, the data rate is determined by the number of speech parameters analyzed in each speech section, the number of bits required for these parameters and the so-called frame rate, i.e. the number of speech sections per second. In the systems presently in use, a minimum of slightly more than 50 bits is needed in order to obtain a somewhat usable reproduction of speech. This requirement automatically determines the maximum frame rate. For example, in a 2.4 kbit/sec system it is approximately 45/sec. The quality of speech with these relatively low frame rates is correspondingly poor. It is not possible to increase the frame rate, which in itself would improve the quality of speech, because the predetermined data rate would thereby be exceeded. To reduce the number of bits required per frame, on the other hand, would involve a reduction in the number of the parameters that are used or a lessening of their resolution which would similarly result in a decrease in the quality of speech reproduction.

OBJECT AND BRIEF SUMMARY OF THE INVENTION

The present invention is primarily concerned with the difficulties arising from the predetermined data rates and its object is to provide an improved process and apparatus, of the previously mentioned type, for increasing the quality of speech reproduction without increasing the data rates.

The basic advantage of the invention lies in the saving of bits by the improved coding of speech parameters, so that the frame rate may be increased. A mutual relationship exists between the coding of the parameters and the frame rate, in that a coding process that is less bit intensive and effects a reduction of redundance is possible with higher frame rates. This feature originates, among others, in the fact that the coding of the parameters according to the invention is based on the utilization of the correlation between adjacent voiced sections of speech (interframe correlation), which increases in quality with rising frame rates.

BRIEF DESCRIPTION OF THE DRAWINGS

The invention is described in greater detail with reference to the drawings attached hereto. In the drawings:

FIGS. 3 and 4 are flow sheets of a program for implementing a coding process according to the invention.

DETAILED DESCRIPTION

Figure 1:
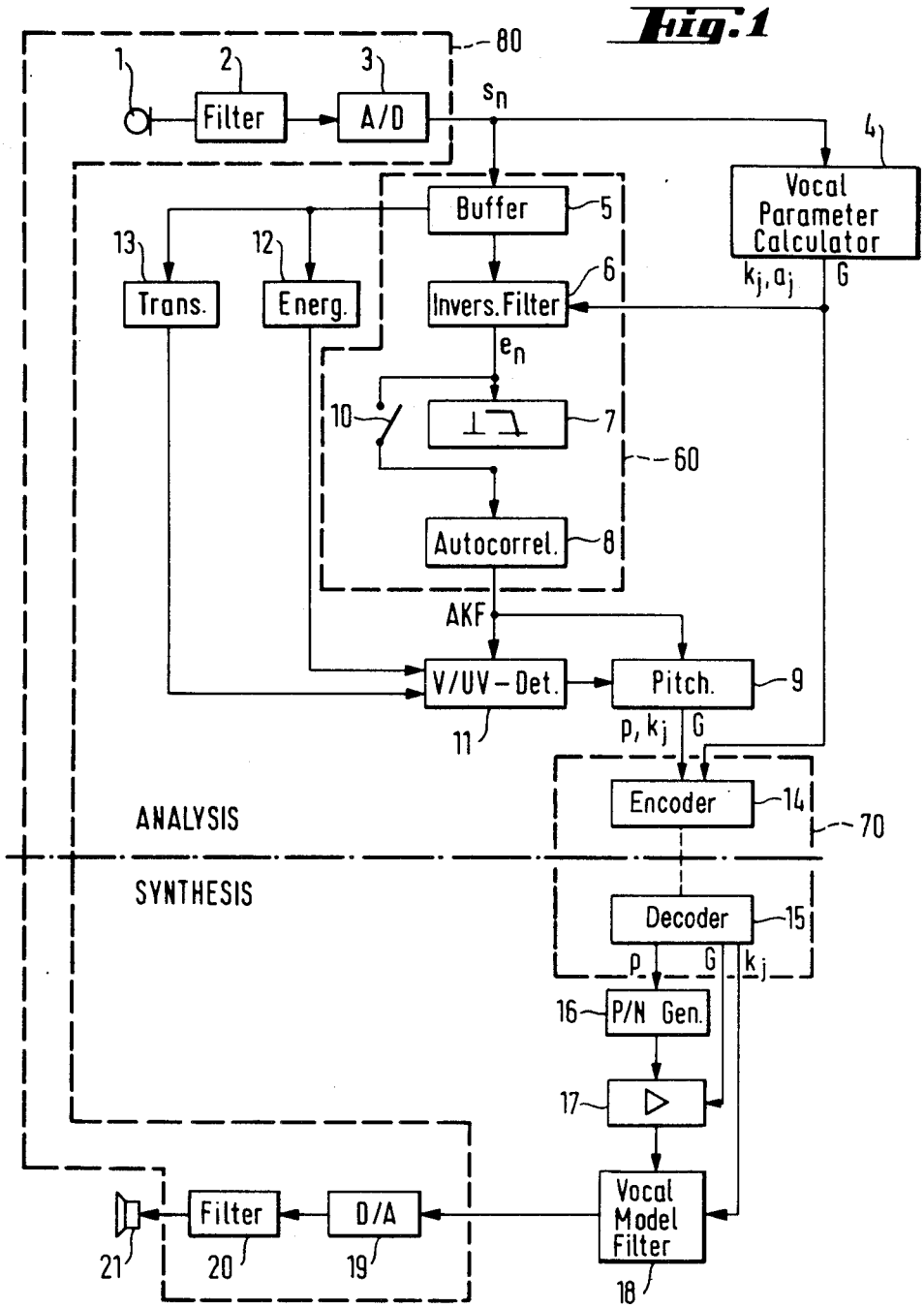
FIG. 1 is a simplified block diagram of an LPC vocoder.

The general configuration of a speech processing apparatus implementing the invention is shown in FIG. 1. The analog speech signal originating in a source, for example a microphone 1, is band limited in a filter 2 and then scanned or sampled in an A/D converter 3 and digitized. The scanning rate is approximately 6 to 16 KHz, preferably approximately 8 KHz.

The resolution is approximately 8 to 12 bits. The pass band of the filter 2 typically extends, in the case of so-called wide band speech, from approximately 80 Hz to approximately 3.1–3.4 KHz, and in telephone speech from approximately 300 Hz to approximately 3.1–3.4 KHz.

For digital processing of the voice signal, the latter is divided into successive, preferably overlapping, speech sections, so-called frames. The length of a speech section is approximately 10 to 30 msec, preferably approximately 20 msec. The frame rate, i.e. the number of frames per second, is approximately 30 to 100, preferably approximately 50 to 70. In the interest of high resolution and thus good quality in speech synthesis, short sections and corresponding high frame rates are desirable. However these considerations are opposed on one hand in real time by the limited capacity of the computer that is used and on the other hand by the requirement of the lowest possible bit rates during transmission.

For each speech section the voice signal is analyzed according to the principles of linear prediction, such as those described in the previously mentioned references. The basis of linear prediction is a parametric model of speech generation. A time discrete all-pole digital filter models the formation of sound by the throat and mouth tract (vocal tract). In the case of voiced sounds the excitation signal $x_n$ for this filter consists of a periodic pulse sequence, the frequency of which, the so-called pitch frequency, idealizes the periodic actuation effected by the vocal chords. In the case of unvoiced sounds the actuation is white noise, idealized for the air turbulence in the throat without actuation of the vocal chords. Finally, an amplification factor controls the volume of the sound. Based on this model, the voice signal is completely determined by the following parameters:

1. The information whether the sound to be synthetized is voiced or unvoiced,
2. The pitch period (or pitch frequency) in the case of voiced sounds (in unvoiced sounds the pitch period by definition equals 0),
3. The coefficients of the all-pole digital filter upon which the system is based (vocal tract model), and
4. The amplification factor.

The analysis is thus divided essentially into two principal procedures, i.e. first the calculation of the amplification factor of sound volume parameters together with the coefficients or filter parameters of the basic vocal tract model filter, and second the voice/unvoiced decision and the determination of the pitch period in the voiced case.

Referring again to FIG. 1, the filter coefficients are defined in a parameter calculator 4 by solving a system of equations that are obtained by minimizing the energy of the prediction error, i.e. the energy of the difference between the actual scanned values and the scanning value that is estimated on the basis of the model assumption in the speech section being considered, as a function of the coefficients. The system of equations is solved preferably by the autocorrelation method with an algorithm developed by Durbin (see for example L. B. Rabiner and R. W. Schafer, "Digital Processing of Speech Signals", Prentice-Hall, Inc. Englewood Cliffs, N.J., 1978, p. 411–413). In the process, the so-called reflection coefficients ($k_j$) are determined in addition to the filter coefficients or parameters ($a_j$). These reflection coefficients are transforms of the filter coefficients ($a_j$) and are less sensitive to quantizing. In the case of stable filters the reference coefficients are always smaller than 1 in their magnitude and their magnitude decreases with increasing ordinals. In view of these advantages, these reflection coefficients ($k_j$) are preferably transmitted in place of the filter coefficients ($a_j$). The sound volume parameter G is obtained from the algorithm as a by-product.

To determine the pitch period p (period of the voice band base frequency) the digital speech signal $s_n$ is initially temporarily stored in a buffer 5, until the filter parameters ($a_j$) are computed. The signal then passes to an inverse filter 6 that is controlled according to the parameters ($a_j$). The filter 6 has a transfer function that is inverse to the transfer function of the vocal tract model filter. The result of this inverse filtering is a prediction error signal $e_n$, which is similar to the excitation signal $x_n$ multiplied by the amplification factor G. This prediction error signal $e_n$ is conducted directly, in the case of telephone speech, or in the case of wide band speech through a low pass filter 7, to an autocorrelation stage 8. The stage 8 generates the autocorrelation function AKF standardized for the zero order autocorrelation maximum. In a pitch extraction stage 9 the pitch period p is determined in a known manner as the distance of the second autocorrelation maximum RXX from the first (zero order) maximum, preferably with an adaptive seeking process.

The classification of the speech section as voiced or unvoiced is effected in a decision stage 11 according to predetermined criteria which, among others, include the energy of the speech signal and the number of zero transitions of the signal in the section under consideration. These two values are determined in an energy determination stage 12 and a zero transition stage 13. A detailed description of one process for carrying out the voiced/unvoiced decision appears in copending, commonly assigned application Ser. No. 421,883, filed Sept. 23, 1982.

The parameter calculator 4 determines a set of filter parameters per speech section or frame. Obviously, the filter parameters may be determined by a number of methods, for example continuously by means of adaptive inverse filtering or any other known process, whereby the filter parameters are continuously readjusted for every scan cycle, and are supplied for further processing or transmission only at the points in time determined by the frame rate. The invention is not restricted in any manner in this respect; it is merely essential that set of filter parameters be provided for each speech section. The $k_j$, G and p parameters which are obtained in the manner described previously are fed to an encoder 14, where they are converted (formatted) into a bit rational form suitable for transmission.

The recovery or synthesis of the speech signal from the parameters is effected in a known manner. The parameters are initially decoded in a decoder 15 and conducted to a pulse noise generator 16, an amplifier 17 and a vocal tract model filter 18. The output signal of the model filter 18 is put in analog form by means of a D/A converter 19 and then made audible, after passing through a filter 20, by a reproducing instrument, for example a loudspeaker 21. The output signal of the pulse noise generator 16 is amplified in an amplifier 17 and produces the excitation signal $x_n$ for the vocal tract model filter 18. This excitation is in the form of white noise in the unvoiced case ($p=0$) and a periodic pulse sequence in the voiced case ($p\neq 0$), with a frequency determined by the pitch period p. The sound volume parameter G controls the gain of the amplifier 17, and the filter parameters ($k_j$) define the transfer function of the sound generating or vocal tract model filter 18.

In the foregoing, the general configuration and operation of the speech processing apparatus has been explained with the aid of discrete operating stages, for the sake of comprehension. It is, however, apparent to those skilled in the art that all of the functions or operating stages between the A/D converter 3 on the analysis side and the D/A converter 19 on the synthesis side, in which digital signals are processed, in actual practice can be implemented by a suitably programmed computer, microprocessor, or the like. The embodiment of the system by means of software implementing the individual operating stages, such as for example the parameter computer, the different digital filters, autocorrelation, etc. represents a routine task for persons skilled in the art of data processing and is described in the technical literature (see for example IEEE Digital Signal Processing Committee: "Programs for Digital Signal Processing", IEEE Press Book 1980).

Figure 2:
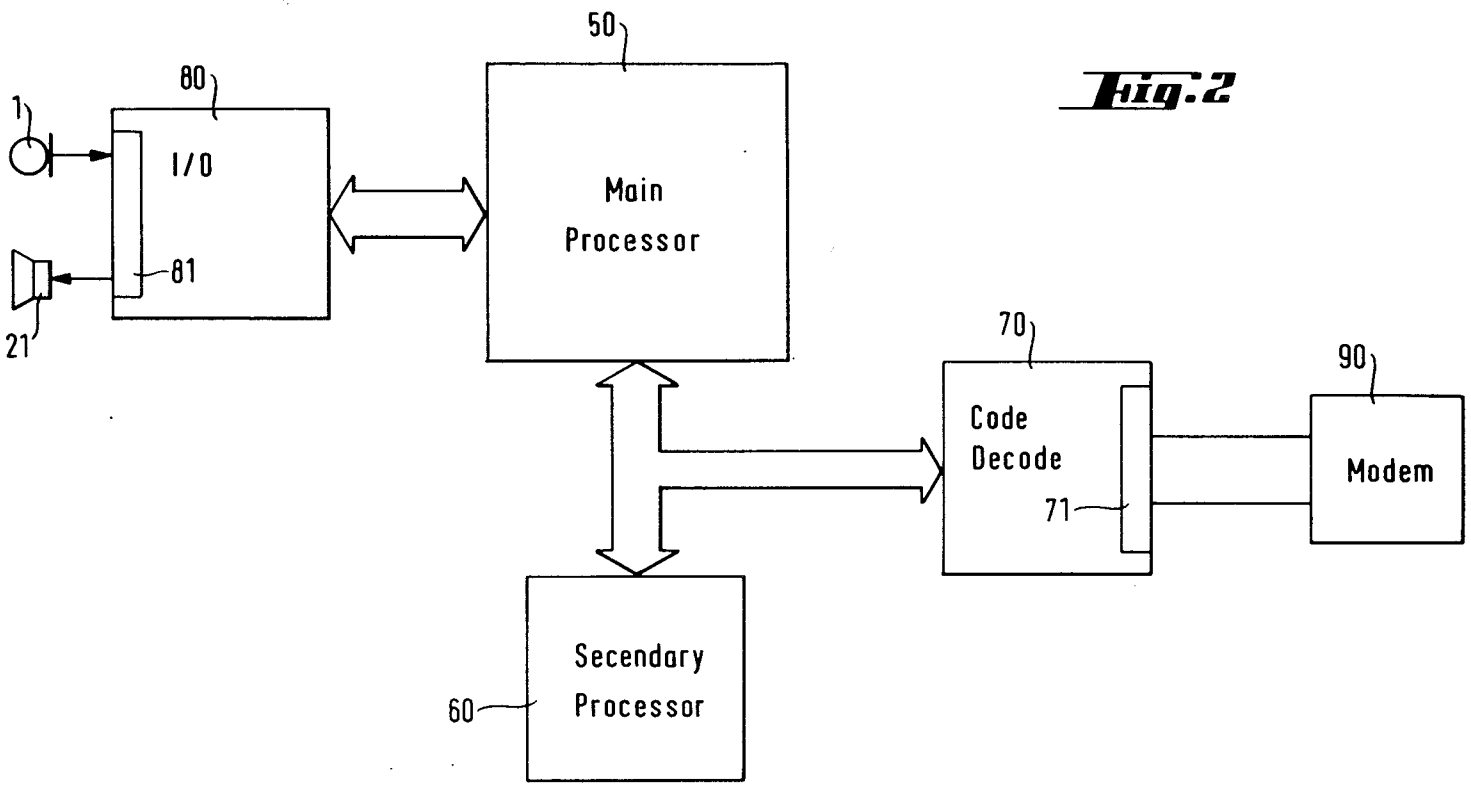
FIG. 2 is a block diagram of a corresponding multiprocessor system.

For real time applications, especially in the case of high scanning rates and short speech sections, vary high capacity computers are required in view of the large number of operations to be effected in a very short period of time. For such purposes multi-processor systems with a suitable division of tasks are advantageously employed. An example of such a system is shown in the block diagram of FIG. 2. The multi-processor system essentially includes four functional blocks, namely a principal processor 50, two secondary processors 60 and 70 and an input/output unit 80. It implements both the analysis and the synthesis.

The input/output unit 80 contains stages 81 for analog signal processing, such as amplifiers, filters and automatic amplification controls, together with the A/D converter and the D/A converter.

The principal processor 50 effects the speech analysis and synthesis proper, which includes the determination of the filter parameters and the sound volume parameters (parameter computer 4), the determination of the power and zero transitions of the speech signal (stages 13 and 12), the voiced/unvoiced decision (stage 11) and the determination of the pitch period (stage 9). On the synthesis side it implements the production of the output signal (stage 16), its sound volume variation (stage 17) and its filtering in the speech model filter (filter 18).

The principal processor 50 is supported by the secondary processor 60, which effects the intermediate storage (buffer 5), inverse filtering (stage 6), possibly the low pass filtering (stage 7) and the autocorrelation (stage 8). The secondary processor 70 is concerned exclusively with the coding and decoding of the speech parameters and the data traffic with, for example, a modem 90 or the like, through an interface 71.

It is known that the data rate in an LPC vocoder system is determined by the so-called frame rate (i.e. the number of speech sections per second), the number of speech parameters that are employed and the number of bits required for the coding of the speech parameters.

In the systems known heretofore a total of 10–14 parameters are typically used. The coding of these parameters per frame (speech section) as a rule requires slightly more than 50 bits. In the case of a data rate limited to 2.4 kbit/sec, as is common in telephone networks, this leads to a maximum frame rate of roughly 45. Actual practice shows, however, that the quality of speech processed under these conditions is not satisfactory.

This problem that is caused by the limitation of the data rate to 2.4 kbit/sec is resolved by the present invention with its improved utilization of the redundance properties of human speech. The underlying basis of the invention resides in the principle that if the speech signal is analyzed more often, i.e. if the frame rate is increased, the variations of the speech signal can be followed better. In this manner, in the case of unchanged speech sections a greater correlation between the parameters of subsequent speech sections is obtained, which in turn may be utilized to achieve a more efficient, i.e. bit saving, coding process. Therefore the overall data rate is not increased in spite of a higher frame rate, while the quality of the speech is substantially improved. At least 55 speech sections, and more preferably at least 60 speech sections, can be transmitted per second with this processing technique.

The fundamental concept of the parameter coding process of the invention is the so-called block coding principle. In other words, the speech parameters are not coded independently of each other for each individual speech section, but two or three speech sections are in each case combined into a block and the coding of the parameters of all of the two or three speech sections is effected within this block in accordance with uniform rules. Only the parameters of the first section are coded in a complete (i.e. absolute value) form, while the parameters of the remaining speech section or sections are coded in a differential form or are even entirely eliminated or replaced with other data. The coding within each block is further effected differentially with consideration of the typical properties of human speech, depending on whether a voiced or unvoiced block is involved, with the first speech section determining the voicing character of the entire block.

Coding in a complete form is defined as the conventional coding of parameters, wherein for example the pitch parameter information comprises 6 bits, the sound volume parameter utilizes 5 bits and (in the case of a ten pole filter) five bits each are reserved for the first four filter coefficients, four bits each for the next four and three and two bits for the last two coefficients, respectively. The decreasing number of bits for the higher filter coefficients is enabled by the fact that the reflection coefficients decline in magnitude with rising ordinal numbers and are essentially involved only in the determination of the fine structure of the short term speech spectrum.

The coding process according to the invention is different for the individual parameter types (filter coefficients, sound volume, pitch). They are explained hereinafter with reference to an example of blocks consisting of three speech sections each.

A. FILTER COEFFICIENTS:

If the first speech section in the block is voiced ($p \neq 0$), the filter parameters of the first section are coded in their complete form. The filter parameters of the second and third sections are coded in a differential form, i.e. only in the form of their difference relative to the corresponding parameters of the first (and possibly also the second) section. One bit less can be used to define the prevailing difference than for the complete form; the difference of a 5 bit parameter can thus be represented for example by a 4 bit word. In principle, even the last parameter, containing only two bits, could be similarly coded. However, with only two bits, there is little incentive to do so. The last filter parameter of the second and the third sections is therefore either replaced by that of the first section or set equal to zero, therby saving transmission in both cases.

According to a proven variant, the filter coefficients of the second speech section may be assumed to be the same as those of the first section and thus require no coding or transmission at all. The bits saved in this manner may be used to code the difference of the filter parameters of the third section with respect to those of the first section with a higher degree of resolution.

In the unvoiced case, i.e. when the first speech section of the block is unvoiced ($p=0$), coding is effected in a different manner. While the filter parameters of the first section are again coded completely, i.e. in their complete form or bit length, the filter parameters of the two other sections are also coded in their complete form rather than differentially. In order to reduce the number of bits in this situation, utilization is made of the fact that in the unvoiced case the higher filter coefficients contribute little to the definition of the sound. Consequently, the higher filter coefficients, for example beginning with the seventh, are not coded or transmitted. On the synthesis side they are then interpreted as zero.

B. SOUND VOLUME PARAMETER (AMPLIFICATION FACTOR):

In the case of this parameter, coding is effected very similarly in the voiced and unvoiced modes, or in one variant, even identically. The parameters of the first and the third section are always fully coded, while that of the middle section is coded in the form of its difference with respect to the first section. In the voiced case the sound volume parameter of the middle section may be assumed to be the same as that of the first section and therefore there is no need to code or transmit it. The decoder on the synthesis side then produces this parameter automatically from the parameter of the first speech section.

C. PITCH PARAMETER:

The coding of the pitch parameter is effected identically for both voiced and unvoiced blocks, in the same manner as the filter coefficients in the voiced case, i.e. completely for the first speech section (for example 7 bits) and differentially for the two other sections. The differences are preferably represented by three bits.

A difficulty arises, however, when not all of the speech sections in a block are voiced or unvoiced. In other words, the voicing character varies. To eliminate this difficulty, according to a further feature of the invention, such a change is indicated by a special code word whereby the difference with respect to the pitch parameter of the first speech section, which usually will exceed the available difference range in any case, is replaced by this code word. This code word can have the same format as the pitch parameter differences.

In case of a change from voiced to unvoiced, i.e. $p \neq 0$ to $p=0$, it is merely necessary to set the corresponding pitch parameter equal to zero. In the inverse case, one knows only that a change has taken place, but not the magnitude of the pitch parameter involved. For this reason, on the synthesis side in this case a running average of the pitch parameters of a number, for example 2 to 7, of preceding speech sections is used as the corresponding pitch parameter.

As a further assurance against miscoding and erroneous transmission and also against miscalculations of the pitch parameters, in the synthesis side the decoded pitch parameter is preferably compared with a running average of a number, for example 2 to 7, of pitch parameters of preceding speech sections. When a predetermined maximum deviation occurs, for example approximately $\pm 30\%$ to $\pm 60\%$, the pitch information is replaced by the running average. This derived value should not enter into the formation of subsequent averages.

In the case of blocks with only two speech sections, coding is effected in principle similarly to that for blocks with three sections. All of the parameters of the first section are coded in the complete form. The filter parameters of the second speech section are coded, in the case of voiced blocks, either in the differential form or assumed to be equal to those of the first section and consequently not coded at all. With unvoiced blocks, the filter coefficients of the second speech section are again coded in the complete form, but the higher coefficients are eliminated.

The pitch parameter of the second speech section is again coded similarly in the voiced and the unvoiced case, i.e. in the form of a difference with regard to the pitch parameter of the first section. For the case of a voiced-unvoiced change within a block, a code word is used.

The sound volume parameter of the second speech section is coded as in the case of blocks with three sections, i.e. in the differential form or not at all.

In the foregoing, the coding of the speech parameters on the analysis side of the speech processing system has been discussed. It will be apparent that on the synthesis side a corresponding decoding of the parameters must be effected, with this decoding including the production of compatible values of the uncoded parameters.

Figure 3:
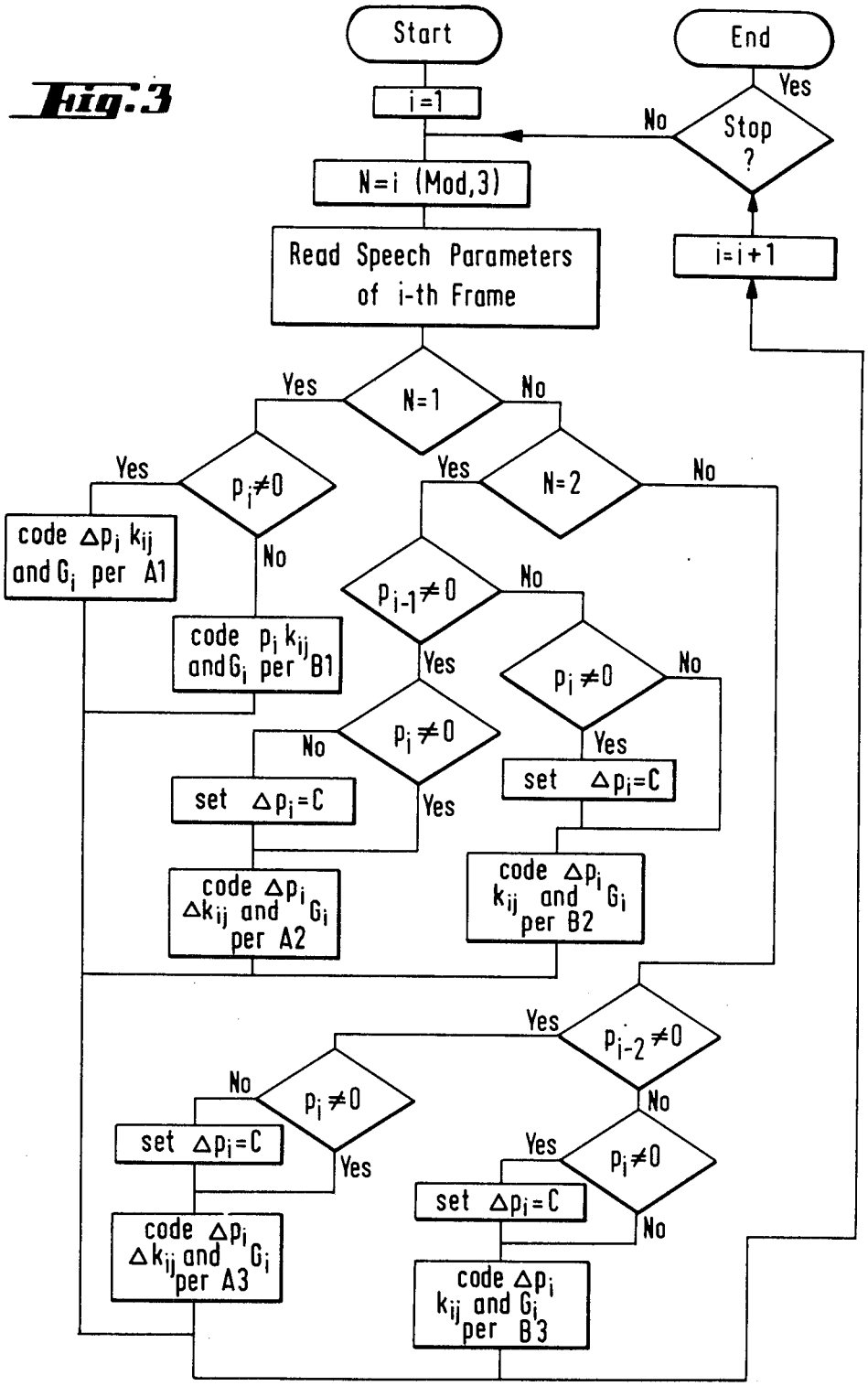

It is further evident that the coding and the decoding are effected preferably by means of software in the computer system that is used for the rest of the speech processing. The development of a suitable program is within the range of skills of a person with average expertise in the art. An example of a flow sheet of such a program, for the case of blocks with three speech sections each, is shown in FIGS. 3 and 4. The flow sheets are believed to be self-explanatory, and it is merely mentioned that the index i numbers the individual speech sections continuously and counts them, while the index $N=i \bmod 3$ gives the number of sections within each individual block. The coding instructions $A_1$, $A_2$ and $A_3$ and $B_1$, $B_2$ and $B_3$ shown in FIG. 3 are represented in more detail in FIG. 4 and give the format (bit assignment) of the parameter to be coded.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. In a linear prediction speech processing system wherein a digital speech signal is divided in the time domain into sections and each section is analyzed to determine the parameters of a speech model filter, a volume parameter and a pitch parameter, a method for coding the determined parameters to reduce bit requirements and increase the frame rate of transmission of the parameter information for subsequent synthesis, comprising the steps of:

combining the determined parameters of at least two successive speech sections into a block of information;

coding the determined parameters for the first speech section in said block in complete form to represent their magnitudes; and coding at least some of the parameters in the remaining speech sections in said block in a form representation of their relative difference in magnitude from the corresponding parameters in said first speech section.

2. The method of claim 1, wherein the coding of the parameters of a speech model filter for said remaining speech sections is effected in one of two manners dependent on whether the first speech section of a block of speech sections is voiced or unvoiced.

3. The method of claim 2, wherein said block contains three speech sections, and in the case with a voiced first speech section the filter parameters and the pitch parameter of the first section are coded in the complete form and the filter parameters and the pitch parameter of the two remaining sections are coded in the form of their differences with regard to the parameters of one of the preceding sections, and in the case of an unvoiced first speech section, the filter parameters of higher orders are eliminated and the remaining filter parameters of all three speech sections are coded in complete form and the pitch parameters are coded as in the voiced case.

4. The method of claim 2, wherein said block contains three speech sections and in the case with a voiced first speech section the filter parameters and the pitch parameter of the first section are coded in complete form, the filter parameters of the middle speech section are not coded at all and the pitch parameter of this section is coded in the form of its difference with respect to the pitch parameter of the first section, and the filter and pitch parameters of the last section are coded in the form of their differences with respect to the corresponding parameters of the first section, and in the case of an unvoiced first speech section the filter parameters of higher order are eliminated and the remaining filter parameters of all three speech sections are coded in the complete form and the pitch parameters are coded as in the voiced case.

5. The method of claim 1, wherein said block contains two speech sections, and in the case with a voiced first speech section the filter and pitch parameters of the first speech section are coded in complete form and the filter parameters of the second section are not coded at all or in the form of their differences with respect to the corresponding parameters of the first section and the pitch parameter of the second section is coded in the form of its difference with respect to the pitch parameter of the first section, and in the case of an unvoiced first speech section the filter parameters of higher order are eliminated and the remaining filter parameters of both sections are coded in their complete form and the pitch parameters are coded as in the voiced case.

6. The method of claim 3 or 4, wherein with a voiced first speech section the sound volume parameters of the first and the last speech sections are coded in their complete form and that of the middle section is not coded at all, and in the case of an unvoiced first speech section the sound volume parameter of the first and the last speech sections are coded in complete form and that of the middle section is coded in the form of its difference with respect to the sound volume parameter of the first section.

7. The method of claim 3 or 4, wherein either in a voiced or unvoiced first speech section the sound volume parameters of the first and last speech sections are coded in their complete form and that of the middle section is coded in the form of its difference with respect to the sound volume parameter of the first section.

8. The method of claim 5, wherein in the case of a voiced first speech section the sound volume parameter of the first speech section is coded in its complete form and that of the second speech section is not coded at all, and in the case of an unvoiced first speech section the sound volume parameter of the first section is coded in its complete form and that of the second section is coded in the form of its difference with respect to the sound volume parameter of the first speech section.

9. The method of claim 3, 4 or 5, wherein in the case of a change between voiced and unvoiced speech within a block of speech sections, the pitch parameter of the section in which the change occurs is replaced by a predetermined code word.

10. The method of claim 9, further including the steps of transmitting and receiving the coded signal and synthesizing speech based upon the coded parameters in the received signal, and upon the occurrence of said predetermined code word, when the preceding speech section has been unvoiced a continuing average value of the pitch parameters of a predetermined number of preceding speech sections is used as the pitch parameter.

11. The method of claim 1, further including the steps of transmitting the coded parameters, receiving the transmitted signal, decoding the received parameters, comparing the decoded pitch parameter with a continuing average of a number of preceding speech sections, and replacing the pitch parameter with the continuing average value if a predetermined maximum deviation is exceeded.

12. The method of claim 1, wherein the length of each individual speech section, for which the speech parameters are determined, is no greater than 30 msec.

13. The method of claim 1, wherein the number of speech sections that are transmitted per second is at least 55.

14. Apparatus for analyzing a speech signal using the linear prediction process and coding the results of the analysis for transmission, comprising:

means for digitizing a speech signal and dividing the digitized signal into blocks containing at least two speech sections;

a parameter calculator for determining the coefficients of a model speech filter based upon the energy levels of the speech signal, and a sound volume parameter for each speech section;

a pitch decision stage for determining whether the speech information in a speed section is voiced or unvoiced;

a pitch computation stage for determining the pitch of a voiced speech signal; and coding means for encoding the filter coefficients, sound volume parameter, and determined pitch for the first section of a block in a complete form to represent their magnitudes and for encoding at least some of the filter coefficients, sound volume parameter and determined pitch for the remaining sections of a block in a form representative of their difference from the corresponding information for the first section.

15. The apparatus of claim 14, wherein said parameter calculator, said pitch decision stage and said pitch computation stage are implemented in a main processor and said coding means is implemented in one secondary processor, and further including another secondary processor for temporarily storing a speech signal, inverse filtering the speech signal in accordance with said filter coefficients to produce a prediction error signal, and autocorrelating said error signal to generate an autocorrelation function, said autocorrelation function being used in said main processor to determine said pitch.

* * * * *